US006988722B2

(12) United States Patent
Su

(10) Patent No.: US 6,988,722 B2
(45) Date of Patent: Jan. 24, 2006

(54) PAPER PICKUP MECHANISM

(75) Inventor: Yu-Jen Su, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 108 days.

(21) Appl. No.: 10/699,663

(22) Filed: Nov. 4, 2003

(65) Prior Publication Data

US 2004/0195756 A1 Oct. 7, 2004

(30) Foreign Application Priority Data

Apr. 1, 2003 (TW) ..... 92205106 U

(51) Int. Cl.
*B65H 3/06* (2006.01)

(52) U.S. Cl. ..... 271/117; 271/118; 74/397; 74/414

(58) Field of Classification Search ..... 271/113, 271/117, 118, 109; 74/397, 414
See application file for complete search history.

(56) References Cited

U.S. PATENT DOCUMENTS 5,527,026 A 6/1996 Padget et al.
5,547,181 A * 8/1996 Underwood ..... 271/114
5,775,823 A * 7/1998 Bekki et al. ..... 400/629
6,311,973 B1 * 11/2001 Tanaka et al. ..... 271/314
6,547,236 B1 * 4/2003 Yip et al. ..... 271/115
6,648,322 B2 * 11/2003 Park ..... 271/117
2004/0007807 A1 * 1/2004 Fujiwara ..... 271/113

FOREIGN PATENT DOCUMENTS

JP 59-31231 * 2/1984
JP 3-267228 * 11/1991
JP 4-140230 * 5/1992

* cited by examiner

*Primary Examiner*—Donald Walsh
*Assistant Examiner*—Thomas Morrison
(74) *Attorney, Agent, or Firm*—Rabin & Berdo, P.C.

(57) ABSTRACT

A paper pickup mechanism located on one side of a feeding paper tray consists of a pickup roller, a plurality of gears and a plurality of linkage bars to form a highly free mechanism that drives the pickup roller rotating in the paper feeding direction and generating a torque to enable the pickup roller exerting a force on the top paper of the paper tray and provide an automatic compensating paper pickup force. By rearranging the structural locations of the elements, fewer gears are required to transmit the driving power, and energy loss and noise generation are reduced.

14 Claims, 7 Drawing Sheets

PAPER PICKUP MECHANISM

FIELD OF THE INVENTION

The invention relates to a paper pickup mechanism and particularly to a paper pickup mechanism that employs fewer gears to transmit power to achieve lower energy loss and noise and compensate paper pickup force automatically.

BACKGROUND OF THE INVENTION

In general, the paper conveying mechanisms used in copiers, printers or facsimile machines have two rubber rollers that have a greater friction coefficient. One serves as a pickup roller and the other serves as a feed roller. The paper located on the top layer is firstly separated by the pickup roller, and is transferred by the feed roller to the printing module for printing. The driving power source usually is located between the two rubber rollers. A drive element, such as a gear set or belt, is used to transmit the driving power to the two rollers.

Nowadays, miniaturization and integration is a prevailing trend. Either single function machines such as printers, copiers, FAX machines, or Multi-Function Peripheral (MFP) that integrates the functions of copying, printing, facsimile or scanning have to rearrange and reconfigure the structure to catch up with this trend. Hence to simplify the existing paper pickup or feeding mechanism has become unavoidable.

Using the paper pickup mechanism that has gear sets to transmit driving power to the pickup roller, there's friction between gears. As a result, energy is lost and noise is generated when the gears transmit the driving power. Therefore, it is preferable to have as few gears as possible. However, this is not always attainable in a practical mechanism. In a conventional power transmission design, it is not uncommon to find more than ten gears of different sizes. There are several reasons why. One is the constraint of a gear transmission path in the structural design, and the other is to enable the pickup roller to have automatic compensating capability.

Take U.S. Pat. No. 5,527,026 assigned to LEXMARK Co. of U.S.A. for instance. Its drive roller 13 is pivotally engaged with a gear located on the bottom of a gear train 1. A drive gear 3 located at the front end of the gear train is stationary. The entire gear train 1 and the drive roller 13 are rotatable according to the amount of paper so that the drive roller 13 is always located on the surface of the paper on the top. When all the gears in the gear train 1 rotate and drive the drive roller 13, a torque is generated to enable the driver gear to exert a normal force to the paper on the top. The normal force is alterable depending on the properties of the paper, such as variety of weight, density and stiffness. Thus an automatic compensation pickup force is generated according to different properties of the paper, therefore multi-feeds or feeding failure of paper may be avoided.

In other words, if the drive roller is pivoted on a "swing arm" such as the gear train mentioned above, the pickup roller is constantly in contact with the paper on the top. Then no matter how much paper is in the paper tray, the normal fore alters according to the properties of the paper.

As the driving power source is located between the pickup roller and the feed roller, as indicated in U.S. Pat. No. 5,527,026 to LEXMARK Co., the driving power source must be located on the paper feeding direction 17. Hence the shortest driving power transmission path should have a drive gear 3 of a gear chain 1 to be located between the drive roller 13 and the driving power source. On the contrary, in the cited reference, the driving power must be transmitted to the drive gear 3 located at the remote location. Thus it needs more gears. As a result, power loss and noise generation are more severe.

SUMMARY OF THE INVENTION

The primary object of the invention is to overcome the aforesaid problems of conventional paper pickup mechanisms that use too many gears and incur severe power loss and noise generation.

The paper pickup mechanism of the invention mainly includes driver gear, idler gear, a swing arm, pickup gear and a pickup roller. The driver gear receives rotation power transmitted from a driving power source and has a still spindle. The idler gear engages with the driver gear and has a spindle connecting to the spindle of the driver gear through a first linkage bar. The swing arm has a pivoted end and a swing end and rotates around the pivoted end. The pickup gear is located on the swing end of the swing arm and is engaged with the idler gear, and a second linkage bar links rotation axes of these two gears. The pickup roller is coaxial with the pickup gear and is driven by the driver gear to rotate in paper feeding direction, to generate a torque to allow the pickup roller to exert a force on the paper on the top of the feeding paper tray.

The pickup mechanism of the invention can provide an automatic compensating pickup force for a pickup roller. In addition, by adjusting the arrangement of the position of the elements, fewer gears are required for transmitting the driving power. Thus energy loss and noise generation also are reduced.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
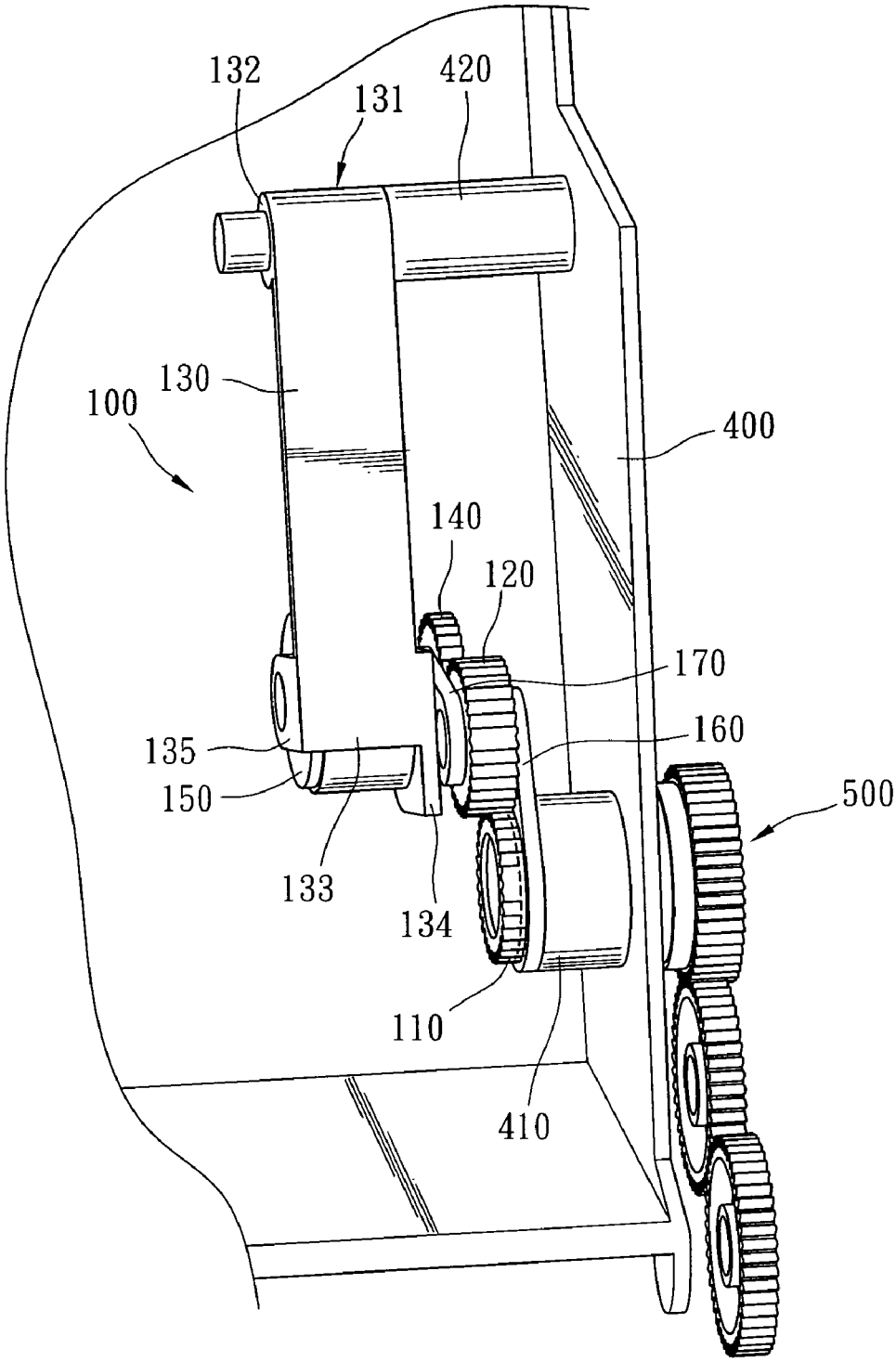
FIG. 1 is a perspective view of the first preferred embodiment of the invention.
Figure 2:
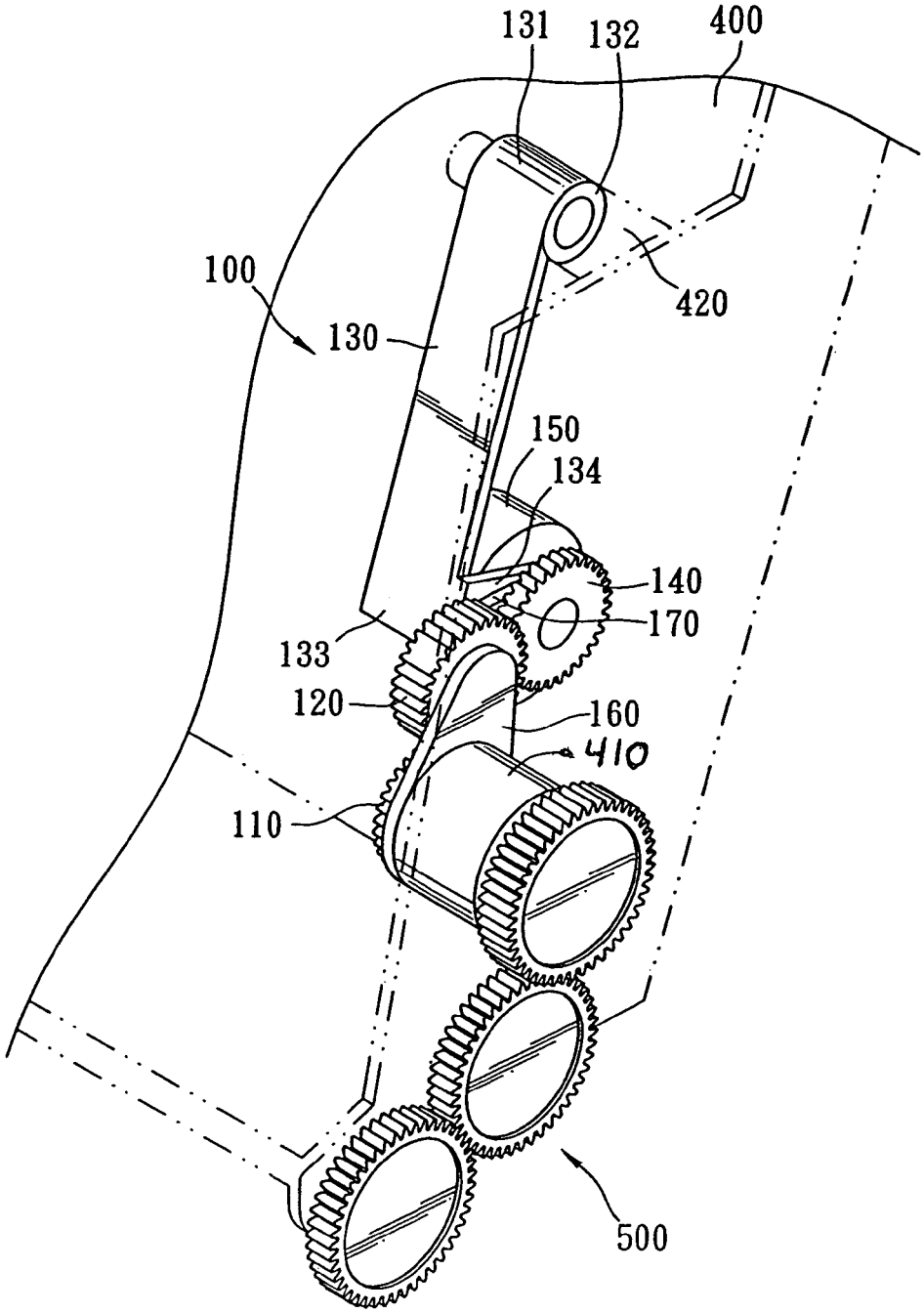
FIG. 2 is another perspective view of the first preferred embodiment of the invention, with the feeding paper tray indicated by broken lines.

Refer to FIGS. 1 through 4 for a first preferred embodiment of the invention. The paper pickup mechanism 100 according to the invention is located on an inner side of a feeding paper tray 400. It mainly includes driver gear 110, idler gear 120, a swing arm 130, pickup gear 140 and pickup roller 150. Their structural and operational configurations are described as follows. Referring to FIGS. 1 and 2, the driver gear 110 is mounted on an axle strut 410 located on an inner side of the feeding paper tray 400. The axle strut is pivoted and engaged with a gear set 500 located on the outer side of the feeding paper tray 400 and is driven to rotate. The gear set 500 transmits rotational power from a driving power source (not shown in the drawings) to the driver gear 110.

The idler gear 120 is engaged with the driver gear 110. Its rotation axis is connected to a first linkage bar 160 formed in an elongated plate.

The swing arm 130 also is formed in an elongated plate. It has a pivoted upper end 131, located upstream relative to the direction of paper feeding 440 from the rotation axis of the idler gear 120, and coupling with a hollow and transverse connecting strut 132 to engage pivotally with an axle 420 extending from the inner wall of the feeding paper tray 400. So the entire swing arm 130 can swing around the connecting strut 132 at the pivoted end 131. The swing arm 130 has a bottom to serve as a swing end 133. The swing end 133 has two sides extending downwards to form respectively a first connection plate 134 and a second connection plate 135.

The pickup gear 140 is mounted on an outer side of the first connection plate 134 of the swing arm 130. It is engaged with the idler gear 120 and its rotation axis is connected to the rotation axis of the idler gear 120 through a second linkage bar 170.

The surface of the pickup roller 150 has a greater friction coefficient and is generally made from rubber. It is located between the first connection plate 134 and the second connection plate 135 of the swing end 133 of the swing arm 130, and is coaxial with the pickup gear 140.

Figure 4:
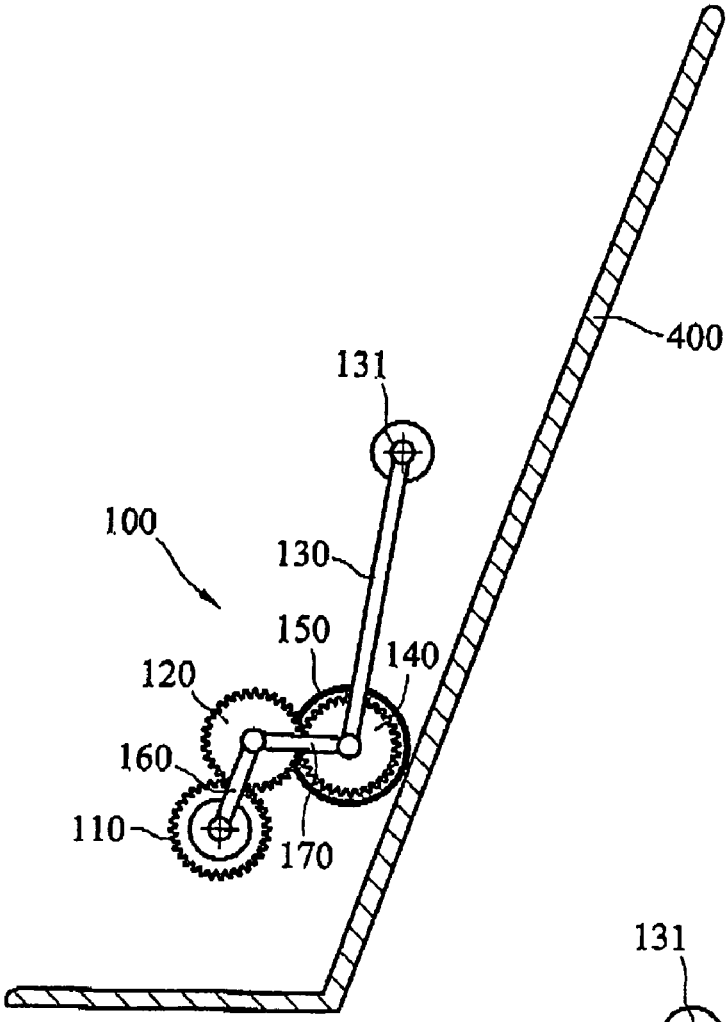
FIG. 4 is a schematic side view of the first preferred embodiment of the invention in an operating condition, showing the pickup mechanism condition when the feeding paper tray is depleted of paper.
Figure 3:
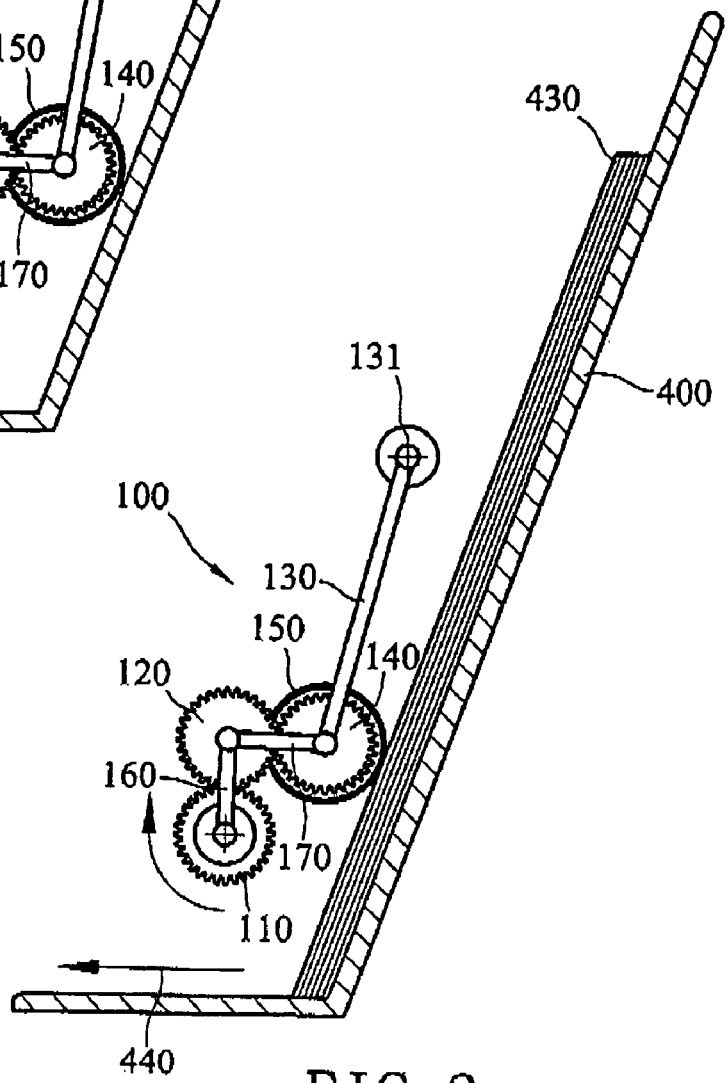
FIG. 3 is a schematic side view of the first preferred embodiment of the invention in an operating condition, showing the pickup mechanism, picking up paper.

Refer to FIGS. 3 and 4 for the configuration of the elements of the paper pickup mechanism 100. The paper pickup mechanism 100 is substantially a "four bar linkage mechanism". In addition to the first linkage bar 160, second linkage bar 170 and the swing arm 130, the distance between the pivoted end 131 of the swing arm 130 and the axle of the driver gear 110 serves as the fourth linkage bar. Because of the property of the "four bar linkage mechanism", the idler gear 120 and the pickup roller 150 have a lot of degree of freedom. Adding the torque generated by rotation, depending on whether there is paper (as shown in FIG. 3) or not (as shown in FIG. 4), the pickup roller 150 can always exert a force in the direction of the feeding paper tray 400.

During the paper pickup process, the driver gear 110, whose rotation axis is located downstream of the rotation axis of the idler gear 120 in the direction of paper feeding 440, receives driving power from the gear set 500 and rotates in clockwise direction, and drives sequentially the idler gear 120, pickup gear 140 and pickup roller 150. The pickup roller 150 rotates clockwise in the direction of paper feeding 440. As the pickup roller 150 is movable and serves as an joint of the "four bar linkage mechanism" that has a lot of degree of freedom, its rotation generates a torque that forms a normal force applying on the paper 430 located on the top of the feeding paper tray 400. The normal force gradually increases until the paper 430 on the top starts moving in the paper feeding direction 440. Namely, the normal force varies depending on the properties of the paper such as weight, density or stiffness. Thus it can automatically compensate the paper pickup force according to different paper properties, without the problems of multi-feeds or feeding failure.

Moreover, prior techniques generally have the driving source locating between the pickup roller and the feed roller, i.e. with the driving source located on the paper feeding direction. But in terms of the embodiment of the invention, the gear set transmits the driving power to the axle rod 420 as shown in FIGS. 1 and 2, i.e. with the pickup roller located between the driving source (on the paper feeding direction 440) and the driver gear. As a result, the whole gear set has to use more gears and causes greater energy loss and noise generation. In contrast, the embodiment has driver gear 110 responsible for the driving located between the driving source and the pickup roller 150. Thus the distance of driving power transmission is shorter, and the number of gears required in the gear set 500 is lower. As a result, noise is lower and energy loss in the power transmission also is less.

Furthermore, in the embodiment, the second linkage bar 170 could be omitted in a practical environment. This is because the driver gear 110 rotates clockwise during the pickup operation (as shown in FIG. 3, with the second linkage bar 170 omitted), and the first linkage bar 160 is driven by friction forces and generates inactivity in clockwise rotation. Consequently, the idler gear 120 also moves toward the paper 430. Thus, the idler gear 120 maintains an engaging condition with the pickup gear 140 during paper pickup and provides a normal force pressing the paper 430. Hence even without the second linkage bar 170, the paper pickup function still is provided.

Figure 5:
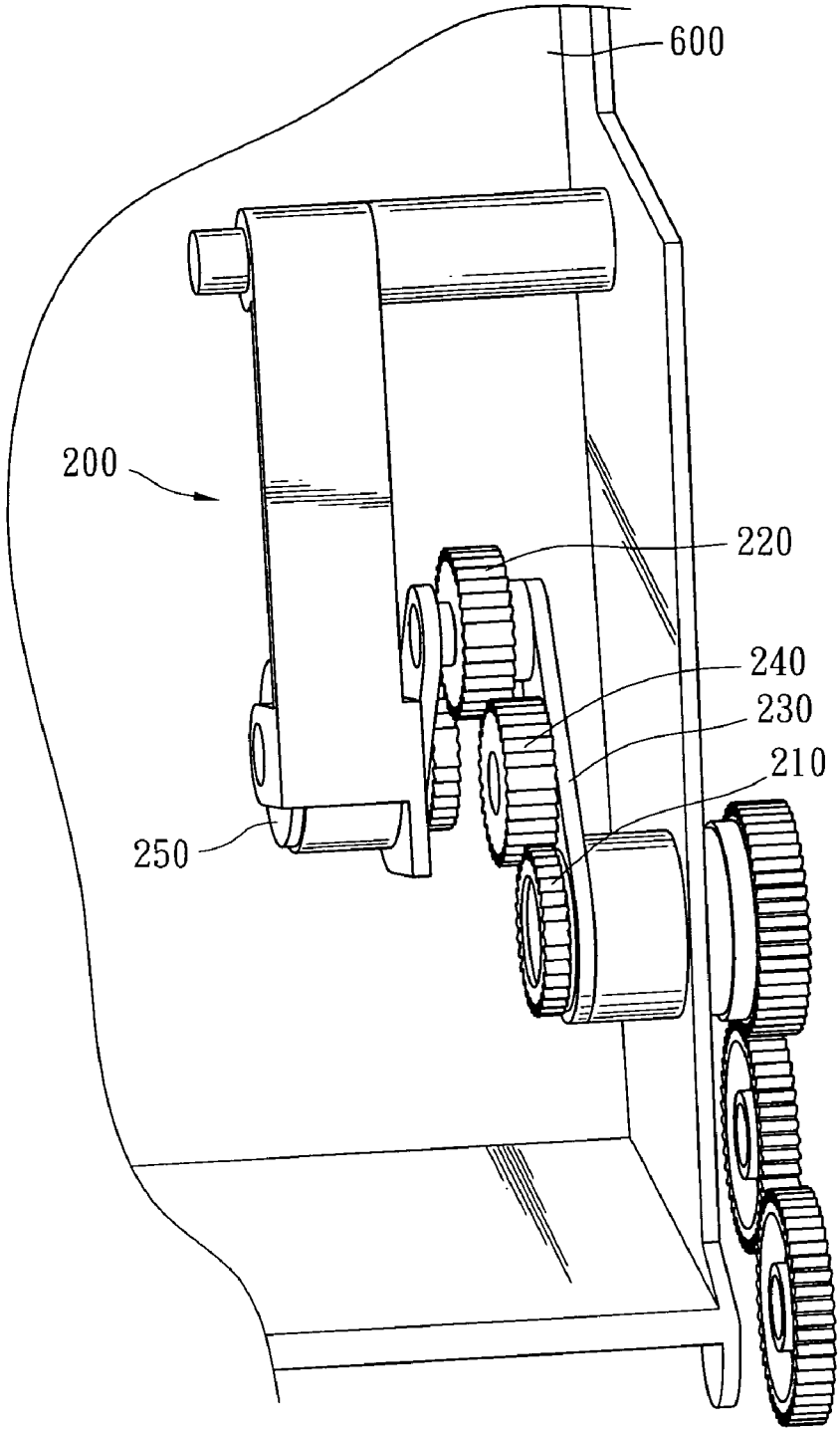
FIG. 5 is a perspective view of the second preferred embodiment of the invention.
Figure 6:
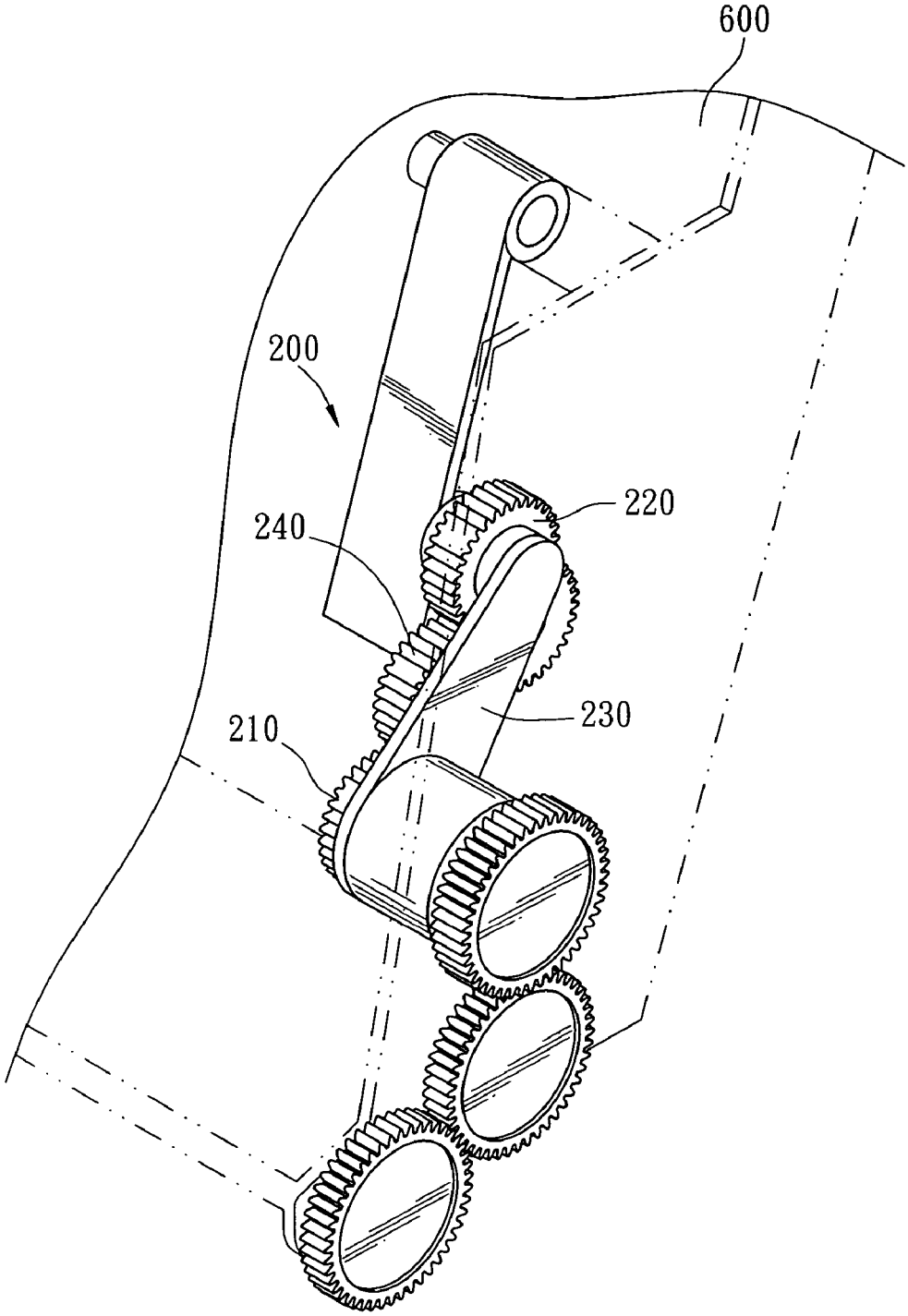
FIG. 6 is another perspective view of the second preferred embodiment of the invention, with the feeding paper tray indicated by broken lines.
Figure 7:
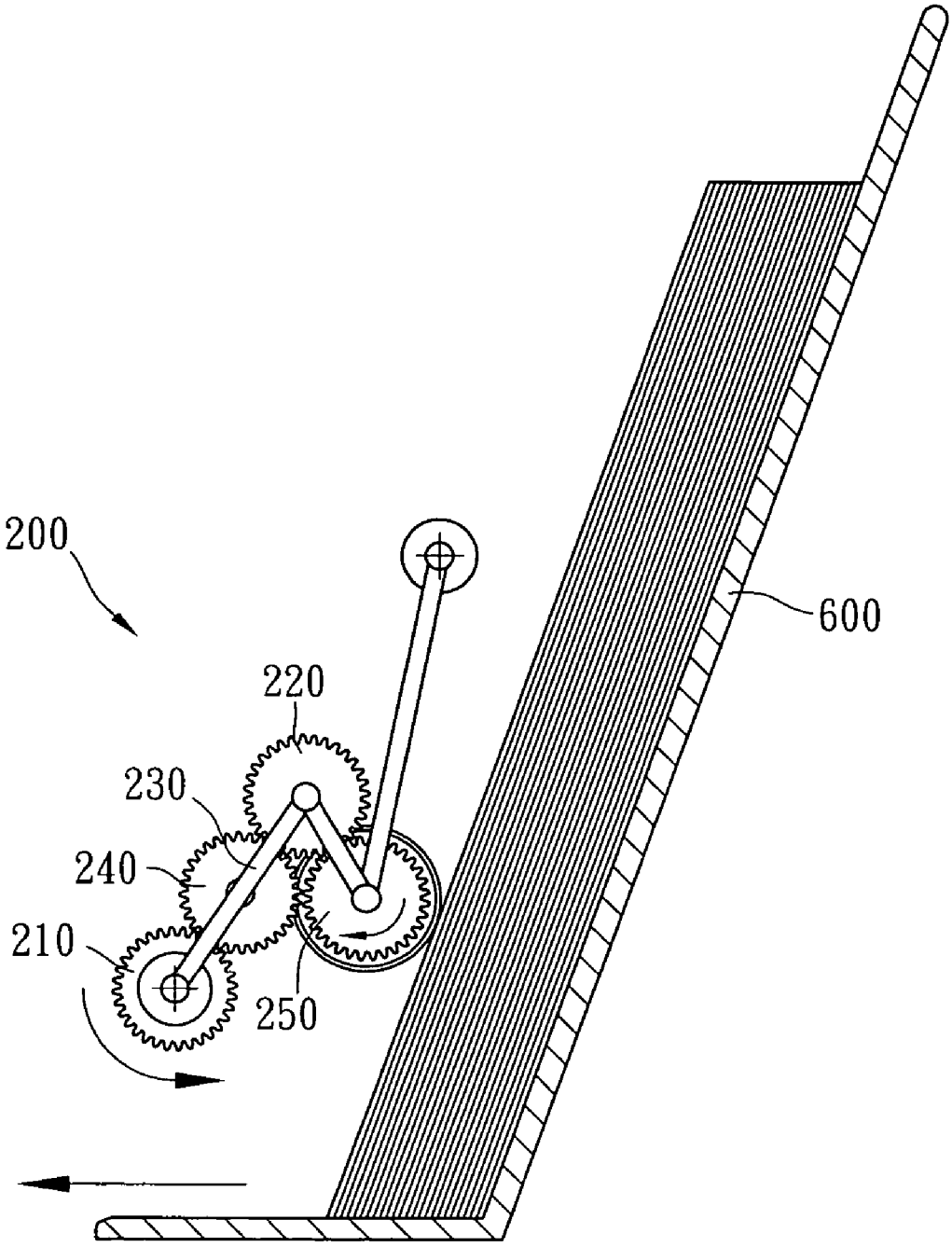
FIG. 7 is a schematic side view of the second preferred embodiment of the invention in an operating condition.

Refer to FIGS. 5, 6 and 7 for a second preferred embodiment of the invention. The main difference between the paper pickup mechanism 200 in this embodiment and the first embodiment is that the first linkage bar 230 has additional gear 240 between the idler gear 220 and the driver gear 210. And the additional gear 240 is engaged respectively with the idler gear 220 and the driver gear 210. Such a design increases the capacity of the feeding paper tray 600. This is because the length of the first linkage bars 230 increases. As a result, the moving range of the pickup roller 250 increases and covers the entire feeding paper tray 600. Of course, a similar approach may also be applied to the second linkage bar between the idler gear and the pickup gear.

Figure 8:
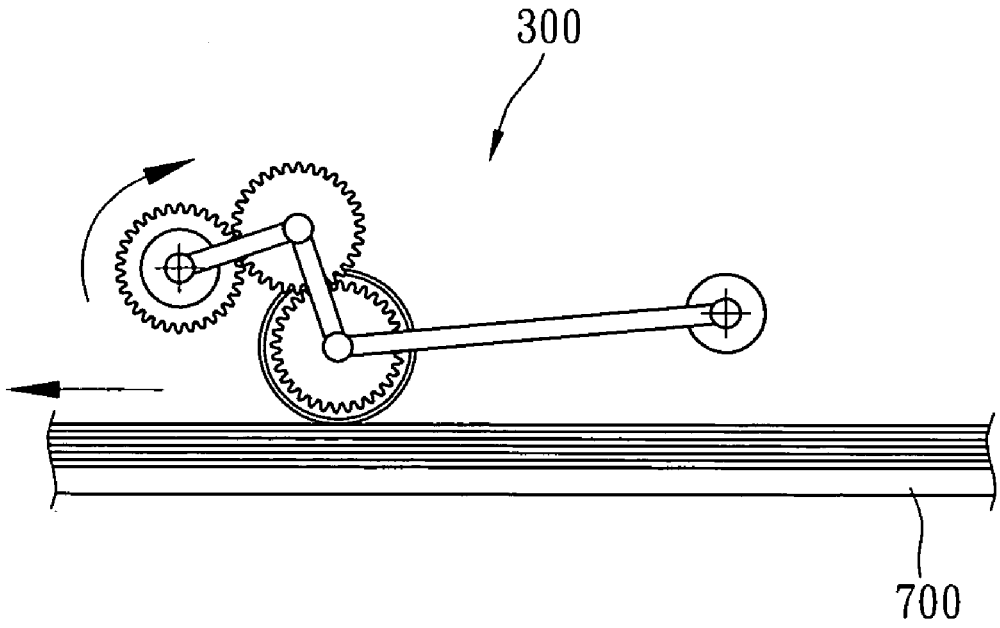
FIG. 8 is a schematic side view of a third preferred embodiment of the invention in an operating condition.

While the two embodiments set forth above are adopted on an upright feeding paper tray, in fact, the invention may also be adapted on a horizontal feeding paper tray as shown in FIG. 8. As the invention essentially employs a "four bar linkage mechanism" during the paper pickup process, the gravity force of the paper pickup mechanism 300 is not an important factor that affects the operation; hence a similar mechanism can also be adapted on a horizontal feeding paper tray 700.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments not departing from the spirit and scope of the invention.

What is claimed is:

1. A paper pickup mechanism located on one side of a feeding paper tray, comprising:

a driver gear for receiving rotational power transmitted from a driving power source having a pivoted axle;

an idler gear driven by the driver gear and having a rotation axis connecting to a rotation axis of the driver gear through a first linkage bar;

a swing arm having a pivoted end and a swing end, the swing arm being rotatable around the pivoted end;

a pickup gear located on the swing end of the swing arm to engage with the idler gear when the idler gear is driven by the driver gear; and a pickup roller being coaxial with the pickup gear and driven by the driver gear to rotate in a paper feeding direction to generate a torque to exert a force on a paper located on a top of the feeding paper tray;

a rotation axis of the pickup gear and the rotation axis of the idler gear being linked through a second linkage bar for engaging the pickup gear and the idler gear with each other; and the first linkage bar extending from the rotation axis of the driver gear to the rotation axis of the idler gear and the second linkage bar extending from the rotation axis of the pickup gear to the rotation axis of the idler gear such that the rotation axis of the driver gear is located downstream of the rotation axis of the idler gear and the pivoted end of the swing arm is located upstream of the rotation axis of the idler gear.

2. The paper pickup mechanism of claim 1, wherein the driver gear is located between the pickup roller and the driving power source.

3. The paper pickup mechanism of claim 1, wherein an additional gear is located between the idler gear and the driver gear.

4. The paper pickup mechanism of claim 3, wherein the additional gear is pivoted on the first linkage bar.

5. The paper pickup mechanism of claim 1, wherein the driver gear is located on an inner side of the feeding paper tray.

6. The paper pickup mechanism of claim 1, wherein the driver gear is mounted on an axle strut located on an inner side of the feeding paper tray.

7. The paper pickup mechanism of claim 1, wherein the driver gear is engaged with a gear set located on an outer side of the feeding paper tray, the gear set transmitting the rotational power from the driving power source to the driver gear.

8. The paper pickup mechanism of claim 1, wherein the pivoted end of the swing arm has a hollow connecting strut.

9. The paper pickup mechanism of claim 1, wherein the pivoted end of the swing arm is pivoted to an axle rod extending from an inner wall of the feeding paper tray.

10. The paper pickup mechanism of claim 1, wherein the swing end of the swing arm is extended to form a first connection plate and a second connection plate.

11. The paper pickup mechanism of claim 10, wherein the pickup gear is located on an outer side of the first connection plate.

12. The paper pickup mechanism of claim 10, wherein the pickup roller is located between the first connection plate and the second connection plate.

13. The paper pickup mechanism of claim 1, wherein the feeding paper tray is an upright paper tray.

14. The paper pickup mechanism of claim 1, wherein the feeding paper tray is a horizontal paper tray.

* * * * *